United States Patent [19]

Radbruch

[11] Patent Number: 4,981,257

[45] Date of Patent: Jan. 1, 1991

[54] PACK PRODUCED FROM A SINGLE-PIECE BLANK

[75] Inventor: Eberhard Radbruch, Kempten, Fed. Rep. of Germany

[73] Assignee: Unilever Patent Holdings BV, Rotterdam, Netherlands

[21] Appl. No.: 391,245

[22] Filed: Aug. 9, 1989

[30] Foreign Application Priority Data

Aug. 30, 1988 [DE] Fed. Rep. of Germany ..... 3829264

[51] Int. Cl.[5] ..... B65D 5/18

[52] U.S. Cl. ..... 229/193; 229/8; 229/198.2

[58] Field of Search ..... 206/621.3, 621.6, 631.2, 206/620; 229/8, 104, 125.42, 193, 198.2

[56] References Cited

U.S. PATENT DOCUMENTS

| | | | |
|---|---|---|---|
| 2,232,088 | 2/1941 | Waters | 229/104 |
| 2,385,898 | 10/1945 | Waters | 229/198.2 |
| 2,508,962 | 5/1950 | Moore | 206/620 |
| 2,593,773 | 4/1952 | Leukoff | 229/193 |
| 2,936,940 | 5/1960 | Berghracht | 229/8 |
| 3,405,859 | 10/1968 | Phillips, Jr. | 229/8 |
| 3,797,726 | 3/1974 | Reil | 206/621.3 |
| 4,550,826 | 11/1985 | Asanuma | 206/259 |

*Primary Examiner*—Gary E. Elkins

*Attorney, Agent, or Firm*—Cushman, Darby & Cushman

[57] ABSTRACT

Pack made from a single-piece board blank which is coated with a sealable plastic layer on its inside, with an at least approximately elliptical base section to which two side panels are hinged which in turn have sealing edge strips divided off from them by folding lines, and with folding lines to divide gusset sections off from the base section and the side panels. The folding lines which divide the base section continue in the side panels where they divide off end panels. Flap extensions are in addition provided on the sealing edge strips, which make it possible to flatten the sealing edge strips against the end panels.

4 Claims, 2 Drawing Sheets

PACK PRODUCED FROM A SINGLE-PIECE BLANK

FIELD OF THE INVENTION

The invention relates to a pack produced from a single-piece blank made from board or a similar material which is coated with a sealable plastic layer on its inner, product contact side, with an at least approximately elliptical base section to which two side panels are hinged which in turn have sealing edge strips divided off from them by folding lines, and with folding lines to divide three gusset sections off from the base section and the two side panels on each narrow side of the pack.

DESCRIPTION OF THE PRIOR ART

U.S. Pat. No. DE-A-24 32 935 already discloses such a pack, where the gusset sections are folded inwards before the sealing edge strips are sealed. This makes the pack comparatively stable and the pack is also tight under normal conditions of use, but it does not withstand high physical demands.

SUMMARY OF THE INVENTION

The purpose of the invention is to create a pack of the kind outlined above which remains tight even when subjected to more exacting requirements.

In the solution to this problem proposed by the invention further folding lines extend across the two side panels as a continuation of the folding lines dividing the base section and divide end panels off from the side panels. Flap extensions are in addition provided on the sealing edge strips of one side panel, with the help of which the sealing edge strips are flattened against the end panels when the pack is erected.

Designed in this way, the pack has an essentially rectangular cross-section, with gusset sections that can be flattened against the bottom of the base. This and the flattening of the sealing edge strips against the end panels with the help of the flap extensions make the pack extremely stiff, so that it remains tight even when sudden high pressure is applied.

The pack is improved further if in accordance with the invention the flap extensions extend into the area of the base section.

In this area, the flap extensions are then flattened against the outside of the base section together with the gusset sections, so that pack stiffness is increased further.

It is also very advantageous if in accordance with the invention the flap extensions extend from the bottom to roughly half way up the pack.

This makes it possible, for example, for the pack to change from a rectangular shape in its bottom section to the shape of a flat pouch in its top section, which can be closed by a transverse sealed seam.

This is improved further if in accordance with the invention crease lines are provided in the top section of the end panels that extend upwards from the folding lines between the side and end panels to the folding line of the sealing edge strips.

One embodiment of the invention is illustrated in the drawings.

DETAILED DESCRIPTION OF THE INVENTION

Figure 1:
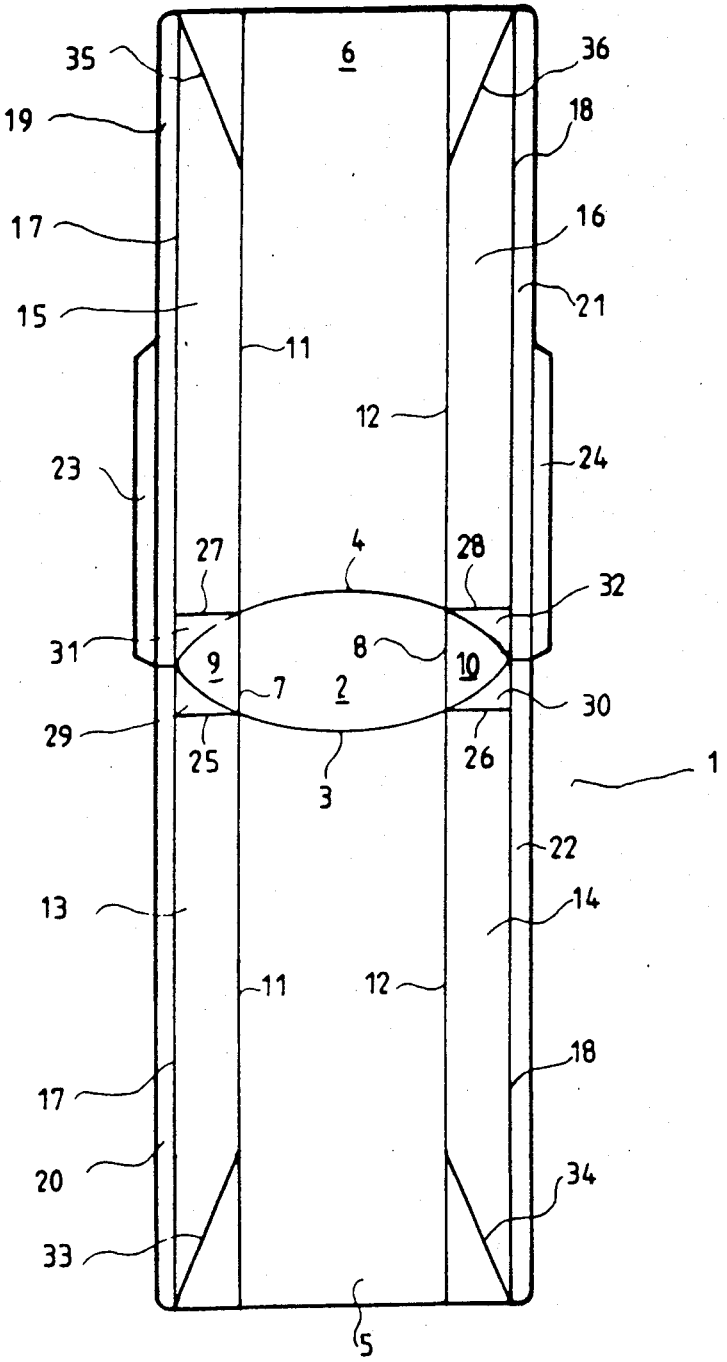
FIG. 1 shows a flat board blank.

1 in FIG. 1 is a board blank which is coated on one side with a sealable plastic layer. The board blank 1 has a base section 2 which has an essentially elliptical shape. The curved lines 3, 4 defining the base section take the form of folding lines, with which two side panels 5 and 6 are hinged to the base section 2. Gusset sections 9/10 are divided off from the base section 2 by further folding lines 7/8. Two further folding lines 11 and 12 extend across the two side panels 5 and 6 as a continuation of these two folding lines 7 and 8 and divide end panels 13, 14, 15 and 16 off from these side panels. Sealing edge strips 19, 20 and 21, 22 are connected to these end panels via folding lines 17 and 18. The two sealing edge strips 19 and 21 allocated to the side panel 6 have flap extensions 23 and 24 which extend from the middle of the base section 2 to about the middle of the side panel 6. Further gusset sections 29, 30, 31, 32, which are located next to the gusset sections 9 and 10, are divided off from the end panels 13, 14, 15, 16 by folding lines 25, 26, 27, 28. In addition, crease lines 33 to 36 extend at an angle across the end panels between the folding lines 11/12 and 17/18.

Figure 2:
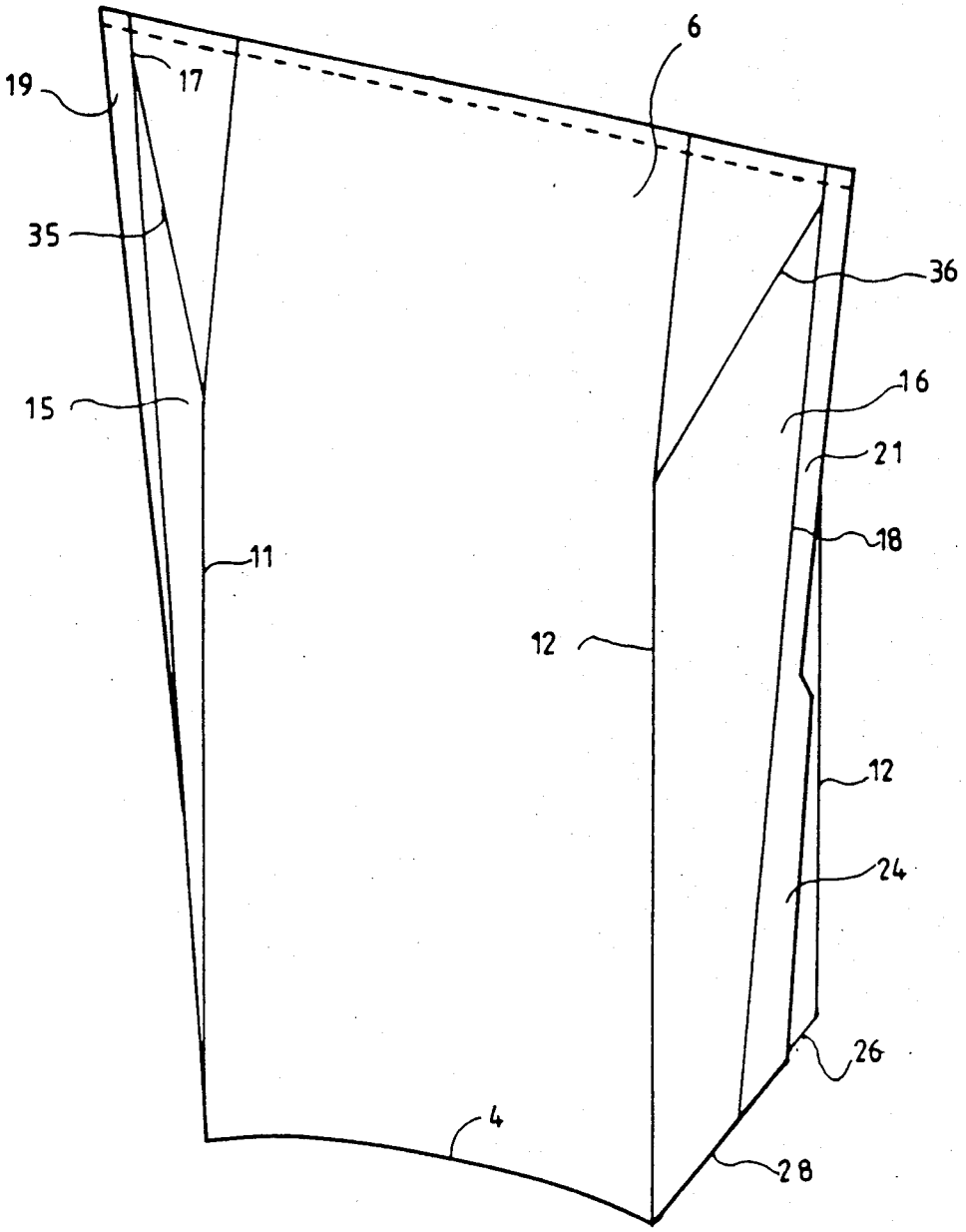
FIG. 2 shows an erected pack with its top closed.

When the board blank is erected into a pack 100 as illustrated in FIG. 2, the side panels 5 and 6 are folded upwards along the folding lines 3 and 4, which leads to the formation of a raised base. After this, the end panels 13 to 16 are folded off from the side panels and the sealing edge strips 19, 20 and 21, 22 are placed on top of each other and sealed together. In the course of this operation, the gusset sections 9, 29, 31 and 10, 30, 32 move towards each other and project downwards. The flap extensions 23, 24 are then flattened against the end panels 13, 14, to which they are attached by gluing. In a final operation, the gusset sections are flattened against the base section 2 where they are also secured by gluing.

The pack that has been produced in this way can now be filled and its top edge can be closed by a transverse sealed seam.

I claim:

1. Pack having relatively wide and narrow sides and produced from a single-piece blank made from board or a similar material and having an inner, product contact side which is coated with a sealable plastic layer, said blank having an at least approximately elliptical base section to which two side panels are hinged which in turn each have a pair of end panels each of which includes a sealing edge strip divided off from said respective end panel by a folding line, and said blank having folding lines to divide, on opposite sides of said base section, three gusset sections both from the base section and from each said side panel on each narrow side of the pack, wherein further folding lines (11,12) extend across the two side panels (5,6) as a continuation of the folding lines (7,8) dividing the base section (2) from a first set of said gusset sections and said further folding lines dividing said end panels (13,14,15,16) off from the side panels, additional fold lines being provided and dividing a second set of said gusset sections from said end panels, and wherein flap extensions (23,24) are provided on the sealing edge strips of one side panel (6), so that the sealing edge strips will be flattened against the end panels (13,14) when the pack is erected.

2. Pack according to claim 1, wherein the flap extensions (23,24) extend from adjacent said gusset sections along said respective end panels.

3. Pack according to claim 1 or 2, wherein the flap extensions (23,24) extend from adjacent the base section to approximately half the length of the pack.

4. Pack according to claims 1 or 2 wherein said end panels have free ends and crease lines are provided adjacent said free ends thereof extending from said further folding lines to said folding lines dividing said end panels from said respective sealing edge strip.

* * * * *